US010167068B2

(12) United States Patent
Bierma

(10) Patent No.: US 10,167,068 B2
(45) Date of Patent: Jan. 1, 2019

(54) APPARATUS FOR ROWING IN THE DIRECTION THE ROWER IS FACING

(71) Applicant: Jochum Bierma, Linz (AT)

(72) Inventor: Jochum Bierma, Linz (AT)

( * ) Notice: Subject to any disclaimer, the term of this patent is extended or adjusted under 35 U.S.C. 154(b) by 549 days.

(21) Appl. No.: 14/843,043

(22) Filed: Sep. 2, 2015

(65) Prior Publication Data

US 2016/0059947 A1 Mar. 3, 2016

(30) Foreign Application Priority Data

Sep. 3, 2014 (AT) ..... A 50607/2014

(51) Int. Cl.
*B63H 16/00* (2006.01)
*B63H 16/10* (2006.01)

(52) U.S. Cl.
CPC ..... *B63H 16/105* (2013.01)

(58) Field of Classification Search
CPC ..... B63H 16/105; B63H 16/00
USPC ..... 416/74; 440/102
See application file for complete search history.

(56) References Cited

U.S. PATENT DOCUMENTS

| | | | |
|---|---|---|---|
| 1,875,498 | A | 9/1932 | Robbin |
| 2,167,636 | A | 8/1939 | Carlson |

FOREIGN PATENT DOCUMENTS

| | | | |
|---|---|---|---|
| DE | 46061 | C | 7/1888 |
| GB | 2 234 217 | A | 1/1991 |
| WO | 2013/126938 | A1 | 9/2013 |

OTHER PUBLICATIONS

English Translation of WO2013126938 A1.*

* cited by examiner

*Primary Examiner* — Mark Laurenzi
*Assistant Examiner* — Paul Thiede
(74) *Attorney, Agent, or Firm* — Collard & Roe, P.C.

(57) ABSTRACT

Apparatus for rowing in the direction the rower is facing has a base frame. A main bearing for a lever with hand grip and another for a lever with oar are in the base frame. A linkage connects the lever with hand grip and lever with oar to form a counteracting four-bar linkage system. The oar lever is the driven arm of the four-bar linkage and is linked to a rotary drive that has a main axle and virtually coaxial actuator rod. The hand grip lever rotates about its axis and is mounted to a bearing body within the base frame. The hand grip lever actuates an actuator that is virtually coaxial to the main axle on the bearing body. The actuator engages with a seesaw mounted on the base frame to shift the actuator rod of the rotary drive to rotate the oar.

8 Claims, 5 Drawing Sheets

APPARATUS FOR ROWING IN THE DIRECTION THE ROWER IS FACING

CROSS REFERENCE TO RELATED APPLICATIONS

Applicant claims priority under 35 U.S.C. § 119 of Austrian Application No. A50607/2014 filed Sep. 3, 2014, the disclosure of which is incorporated by reference.

BACKGROUND OF THE INVENTION

1. Field of the Invention

The invention is for an apparatus for rowing in the direction the rower is facing with a base frame, where the main bearing for a lever with a hand grip, i.e. a grip lever, and for a lever with an oar, i.e. an oar lever, and a linkage that connects the grip lever and the oar lever to form a counteracting four-bar linkage system with actuated bearing body as the driven arm of the four-bar linkage and linked to a rotary drive with a main axle and virtually coaxial actuator

2. Description of the Prior Art

To row in the direction the rower is facing, an oar lever with the oar blade is implemented separately from the grip lever in a way that the oar lever makes the opposite movement so that when the rower makes a recovery stroke in the direction of travel with the grip lever, the oar lever makes a recovery stroke forwards. For this purpose, the prior art is to connect the oar lever to the grip lever using a linkage that creates a counter-acting four-bar linkage. The grip lever and the oar lever are mounted on a base frame with the axes of movement in the direction of travel to ensure that the oar blades enter the water and are drawn out again when the grip lever is raised for the drive stroke and lowered again for the recovery stroke. To feather the oar blades at the end of the drive stroke so that they can pass close to the surface of the water for the recovery stroke and then square them again for the drive stroke, the prior art (WO 2013/126938 A1) is to mount the oar lever so that it is able to rotate about its axis and link it to an actuator that can be moved coaxially to the bearing body and rest on one of the pivot axes for the base frame so that it does not follow the pivot movement of the base frame in the direction of travel and instead converts the movement of the actuator into feathering the oar lever. However, this automatic feathering and squaring of the oar blades as a function of the pivot movement of the grip lever along an axis running in the direction of travel does not allow the rower to have any influence on the position of the oar blades, independently of the position of the base frame.

SUMMARY OF THE INVENTION

The invention forms the basis for an apparatus that allows rowing in the direction the rower is facing while allowing the rower to feather the oar blades in the normal way by rotating the grip lever.

Based on an apparatus of the prior art described above, this invention solves the issue in that the hand grip rotates about its axis so that within the four-bar linkage system, the grip lever is able to rotate and actuate an actuator rod that is virtually coaxial to the main axle on the bearing body, that engages with a seesaw mounted on the base frame to shift the actuator rod on the rotary drive for the oar lever.

The rotary mounting of the grip lever in the bearing body that forms the crank of the four-bar linkage system enables the rower to use the grip to manipulate the oar blade in way that is normal for rowers because the grip lever can not only pivot the base frame over an axis in the direction of travel during the drive stroke and recovery stroke, but also rotate about its own axis. The rotating action about its axis of the grip lever therefore needs to be transferred into a rotating action for the oar lever. For this purpose, the rotating movement of the grip lever is transferred to the actuator rod inside its bearing body—which is virtually coaxial to the main axle of the bearing body in the base frame—and which actuates a seesaw on top of the base frame. The seesaw then transfers the rotating movement of the grip lever to the actuator for rotating the oar lever so that the oar blade is feathered and squared according to the rotating movement of the grip lever. The movement of the actuator virtually coaxial to the axis of rotation of each bearing body inside the base frame ensures that the bearing bodies can rotate about their axes without affecting the transmission of the grip lever position via the actuator rod and the seesaw to the oar lever.

The rotating drive system for the oar lever could be implemented as a toothed rack with a toothed rack for the actuator. However, the preferred design is if the rotating drive system for the oar lever has a toggle joint between the bearing body and the oar lever where the toggle joint is directly linked to the actuator. The rotating movement of the grip lever is then transferred to the seesaw by the actuator that is linked directly to the crank on the grip lever.

The actuators then act directly on the seesaw at one end and the toggle joint at the other end to transfer the rotating movement to the oar lever and the crank at the grip lever. Due to the slight shift in position during the actuation movement in relation to the position of the bearing body axes, the actuators have to be mounted on ball joints to connect to the seesaw and the toggle lever and crank.

A precise coaxial movement of the actuators in relation to the axes of the bearing bodies is desired, so the actuators have to be realized as push rods, i.e. actuator rods, linked to the seesaw with the necessary freedom of movement as well as at the bearing bodies to ensure coaxial movement as they are connected to a linkage at the toggle joint for rotating the oar lever and the crank for transmitting the rotating movement of the grip lever.

In order to facilitate the feathering and squaring of the blade of the oar lever as a result of the movement of the grip lever, the grip lever features a spring configuration that applies torque to the lever. Because opposing torques are required during feathering and squaring of the oar levers, a spring system is configured between the grip lever and the bearing body so that the line of action of the spring configuration intersects the axis of rotation of the grip lever when it is positioned half way between the two limit positions. As a consequence, when the grip lever is rotated so that its position of rotation crosses the line of action of the spring configuration, the direction of torque acting on the grip lever changes so that the spring configuration assists rotation into the desired limit position for feathering or squaring the oar blade.

BRIEF DESCRIPTION OF THE DRAWING

The subject matter of the invention is shown in the drawing by way of example, wherein.

DESCRIPTION OF THE PREFERRED EMBODIMENT

Figure 1:
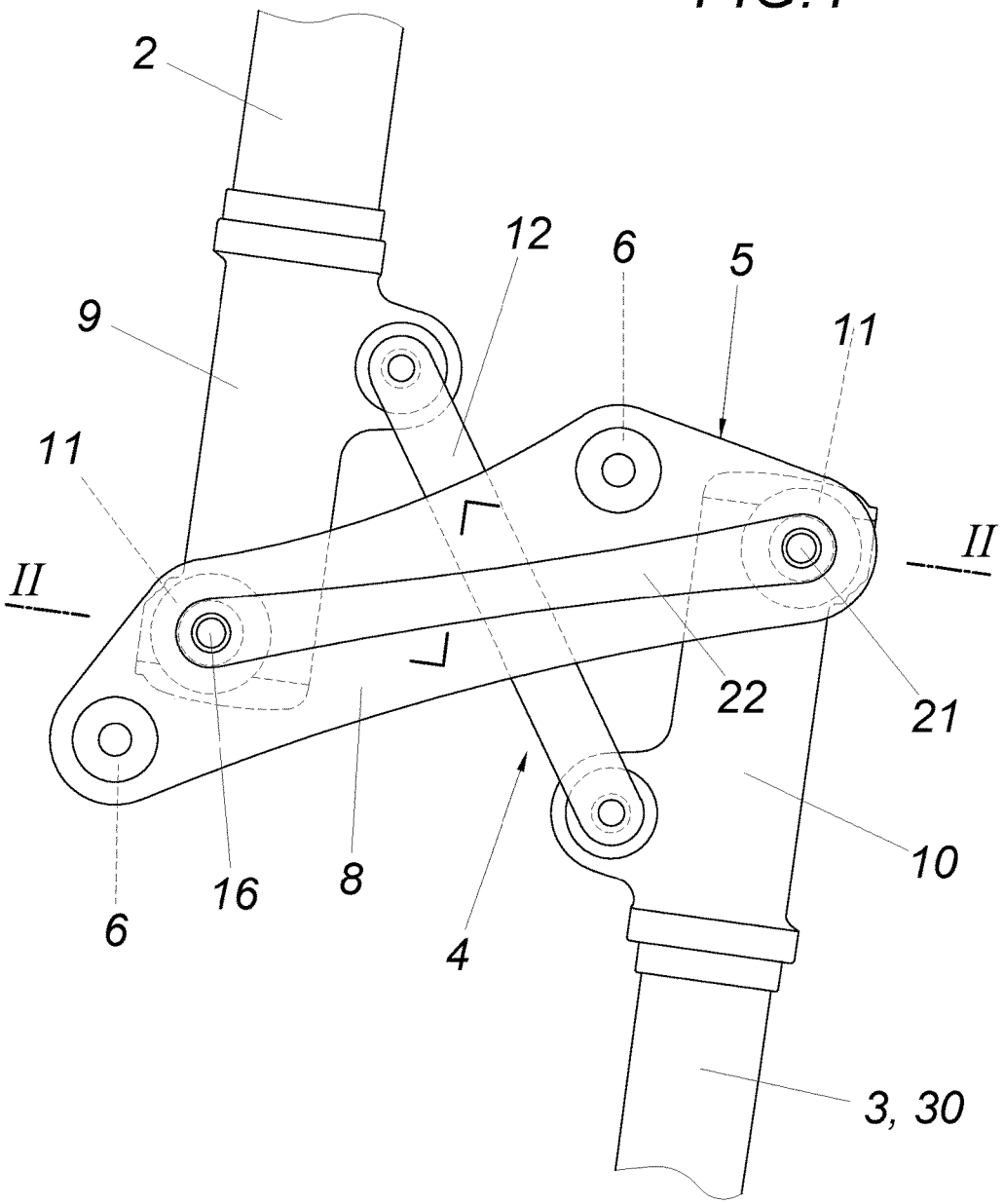
FIG. 1 Plan view of the invention to row in the direction the rower is facing showing the area of the counteracting system between the grip lever and the oar lever, FIG. 2 Section II-II through FIG. 1 shown in a larger scale, FIG. 3 Same section through counter-acting system as FIG. 2 but with a different oar setting, FIG. 4 Same section as FIG. 2 showing a design version of the counter-acting system invention, FIG. 5 Same position of counter-acting system as FIG. 3 but showing detail of the spring configuration for rotating the grip lever, and FIG. 6 Same section as FIG. 5 showing a design version of the spring configuration for applying torque to the grip lever.

The apparatus to row in the direction the rower is facing requires an oar blade (1) mounted on an oar lever (2) with a separate grip lever (3) that is linked to the oar lever (2) by a reversing unit in the form of a counteracting four-bar linkage system (4), as shown in particular in FIG. 1. This four-bar linkage system (4) consists of a base frame (5) with two plates (7, 8) held apart by spacers (6) in which the first and second bearing bodies (9, 10) are mounted on axle bearings. The oar lever (2) is mounted on the first bearing body (9) and is free to rotate about its axis. In the same way, the grip lever (3) is mounted on the second bearing body (10). The second bearing body (10) forms the driving crank of the four-bar linkage system together with the first bearing body (9) and the linkage (12). If the second bearing body (10) is pivoted by the grip lever (3) about its bearing axle (13) mounted in bearings (11), the first bearing body (9) with the oar lever (2) is pivoted in the opposite direction around bearing axle (14) on the first bearing body (9).

To submerge the oar blade (1) in the water and lift it clear of the water again, the base frame (5) is mounted as in the prior art on a pivoting axle that runs parallel to the direction of travel, which is not shown here for reasons of clarity. If the grip lever (3) is pivoted upwards, the oar blade (1) is submerged in the water due to the pivoting movement of base frame (5). Moving the grip lever (3) in the opposite direction lifts the oar blade (1) out of the water again.

Figure 2:
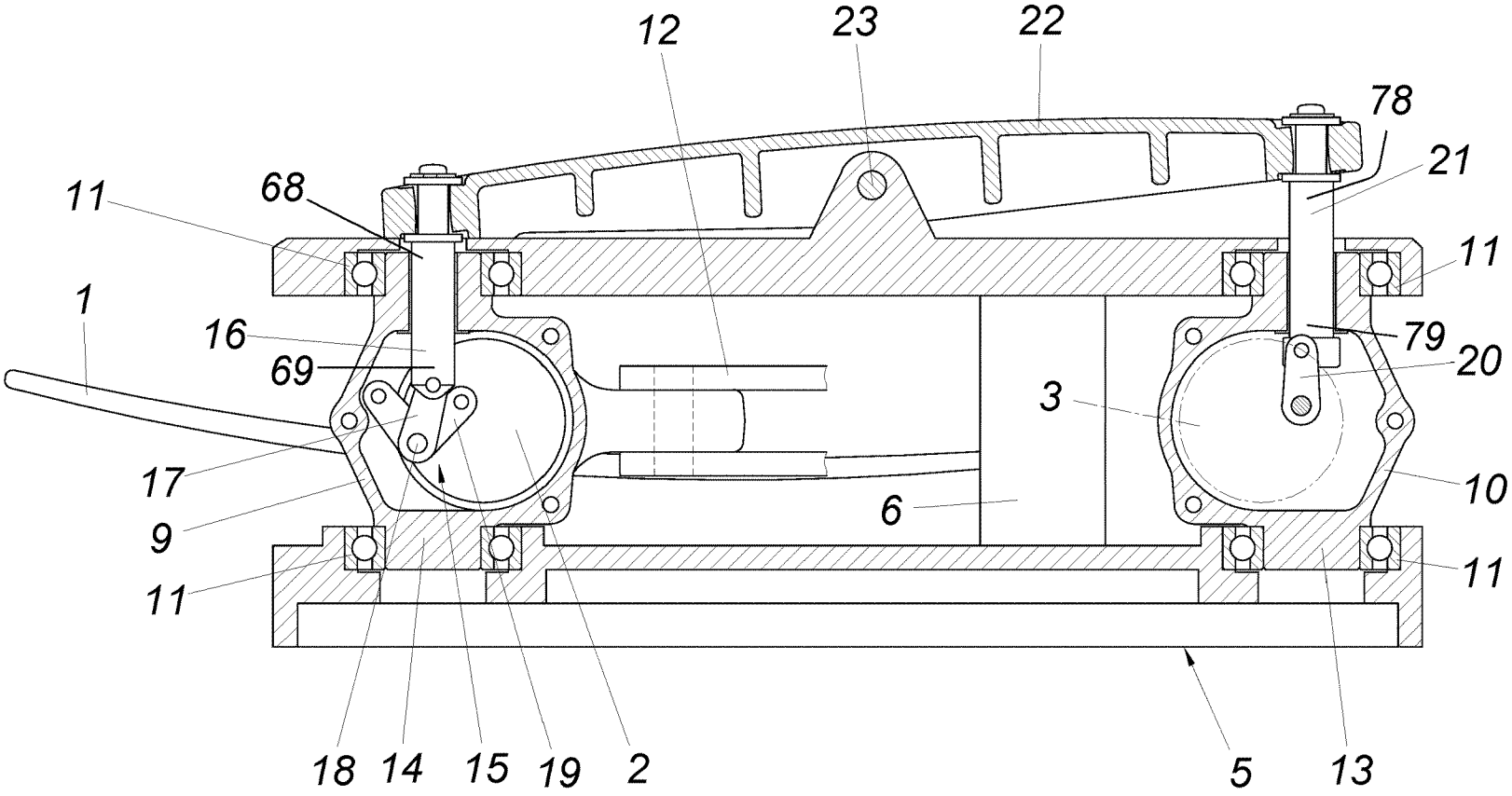
Figure 3:
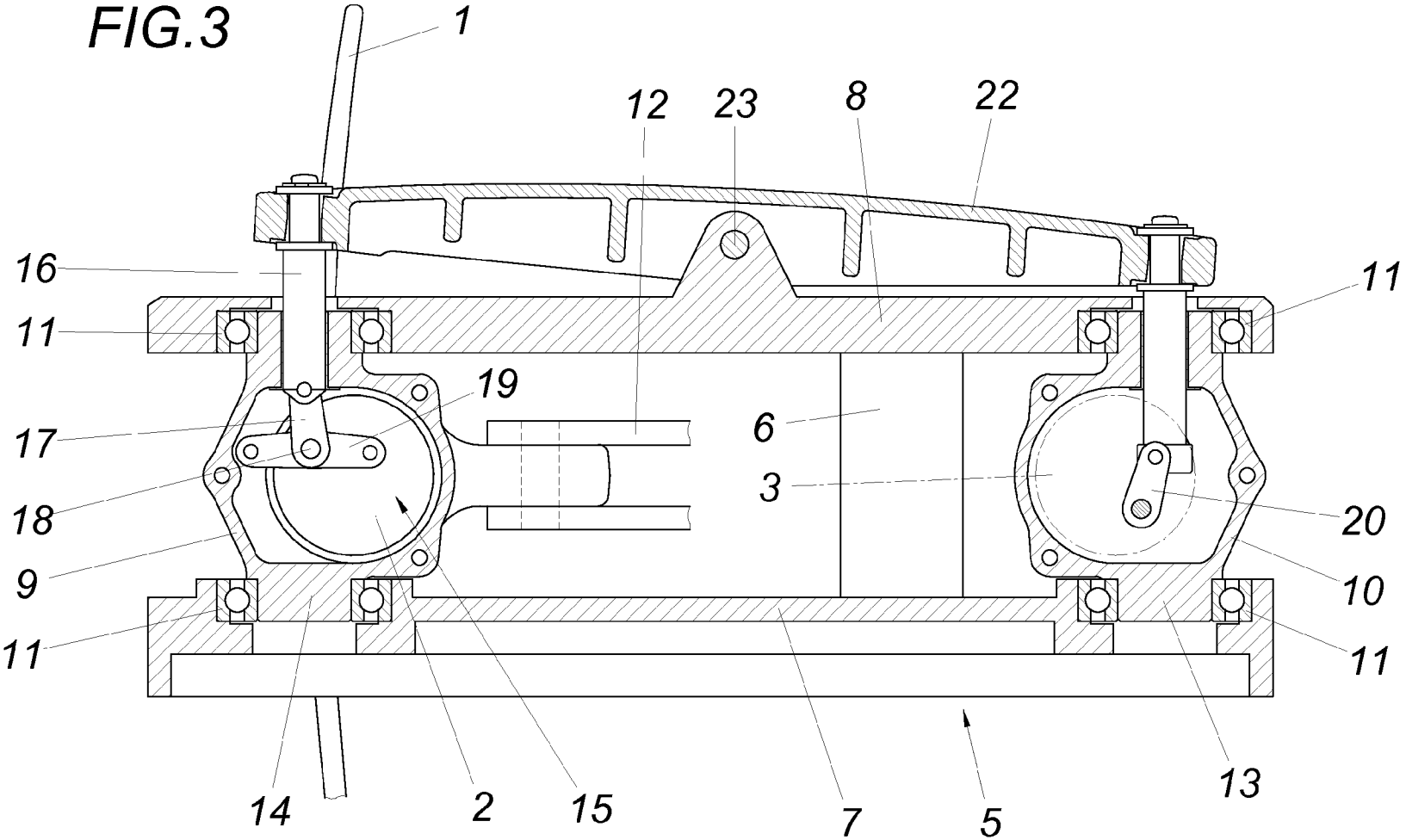
Figure 4:
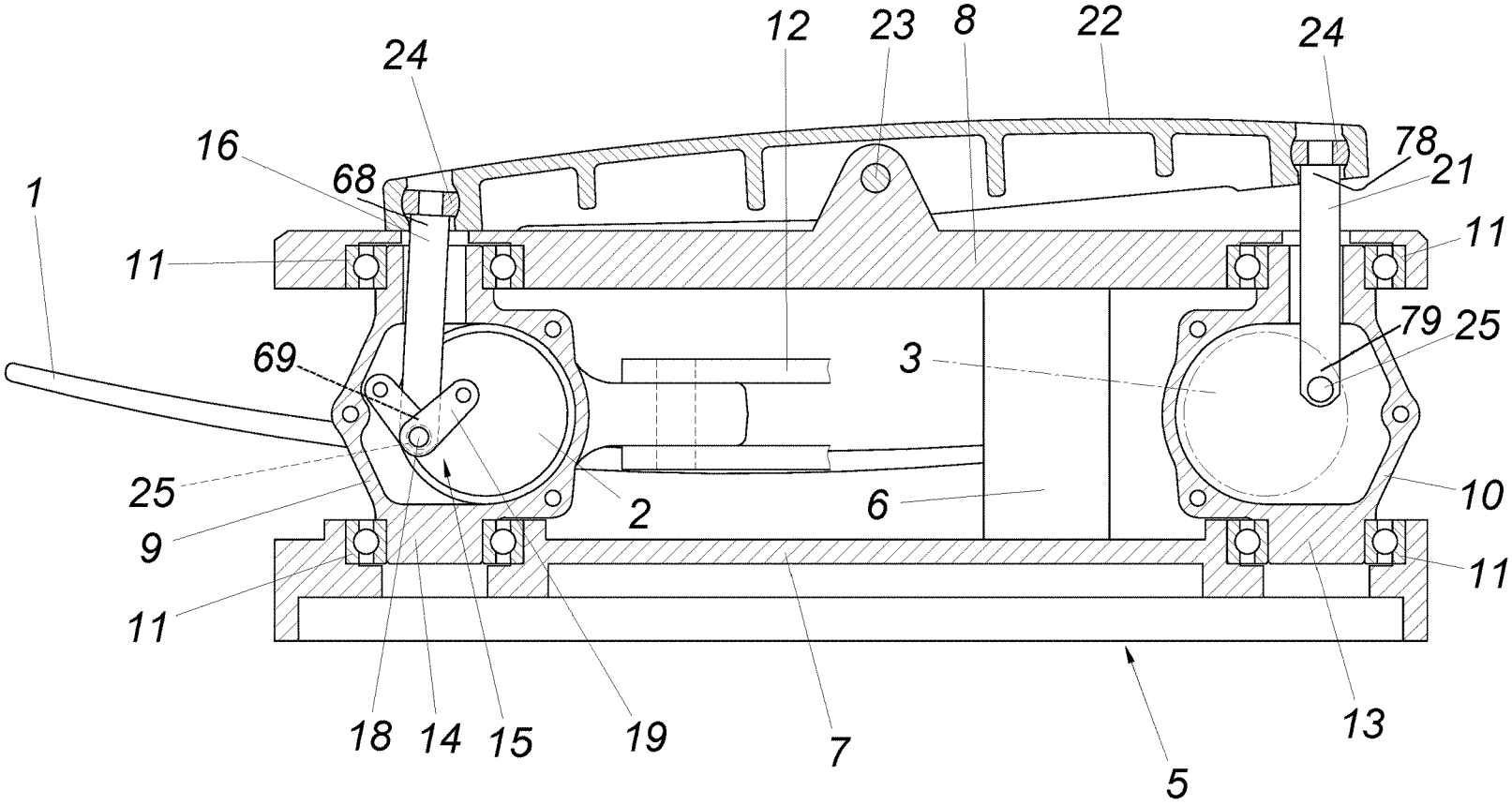

When the oar blades (1) enter the water, they are to be squared as shown in FIG. 1 and then at the end of the drive stroke are to be feathered—parallel to the surface of the water—during the recovery stroke, as shown in FIG. 2. The feathering and squaring of the oar blades is normally controlled by the rower, who rotates the grip of the oar accordingly. In order to achieve the same control of the oar blades (1) using the oar lever (2) and the separate grip lever (3), a rotary drive (15) is provided for the oar lever (2) in the first bearing body (9) that is actuated by the first actuation rod (16) that, in accordance with FIGS. 1 to 3 is implemented to be shifted coaxially to main bearing (14) in the first bearing body (9), that in accordance with the implementation examples shown actuates a toggle lever (19) via a lug (17) and a toggle joint (18), that connects the first bearing body (9) with the oar lever (2). When the first actuator rod (16) moves upwards from the position shown in FIG. 2 to extend the toggle lever (19), then in doing so it rotates the oar lever (2) within the first bearing body (9), so that the oar blade moves from the feathered position shown in FIG. 2 to the squared position for the drive stroke as shown in FIG. 3.

So that the feathering and squaring of the oar blade (1) can be controlled by rotating the grip lever (3) in the second bearing body (10), the grip lever (3) forms a crank (30) that actuates the connecting link (20) which is linked to the second actuator rod (21). In the same way that the first actuator rod (16) acts on the rotary drive (15), the second actuator rod (21) is mounted coaxially to the axis of rotation of axle (13) on the second bearing body (10) for the grip lever (3) so that the second actuator rod (21) can be shifted up and down in its guideway. To transmit the movement of the second actuator rod (21) to the first actuator rod (16) for the rotary drive (15), there is a seesaw (22) mounted on top of base frame (5). Actuator rods (16) and (21) are free to move in accordance with the movements of seesaw (22), which pivots about its axis (23) and transmits the linear movements of the first actuator rod (16) to the linear movements of the second actuator rod (21). Depending on the direction of rotation of the grip lever (3), the oar lever (2) can be rotated to feather and square the oar blade (1).

Compared to FIGS. 1 to 3, FIG. 4 shows a different implementation with second and first actuator rods (21 and 16) directly linking seesaw (22) with the crank of the grip lever (3) and linking seesaw (22) with the rotary drive (15). In this case, the second and first actuator rods (21 and 16) deviate from the axis of the main bearings (13 and 14), which needs to be compensated by ball joints (24, 25). Otherwise, the principle sequence of movement remains the same. The first actuator rod (16) is connected by a ball joint (24) to the seesaw (22) at the first actuator end (68) and by another ball joint (25) to the toggle joint (18) of the rotary drive (15) at the second actuator end (69). The second actuator rod (21) is connected by a ball joint (24) to the seesaw (22) at its first end (78) and by another ball joint (25) to the grip lever (3) at its second end (79). The first actuator rod (16) is connected to the seesaw (22) at the first actuator end (68) and to the lug (17) of the rotary drive (15) at the second actuator end (69). The second actuator rod (21) is connected to the seesaw (22) at its first end (78) and to the connecting link (20) at its second end (79).

Figure 6:
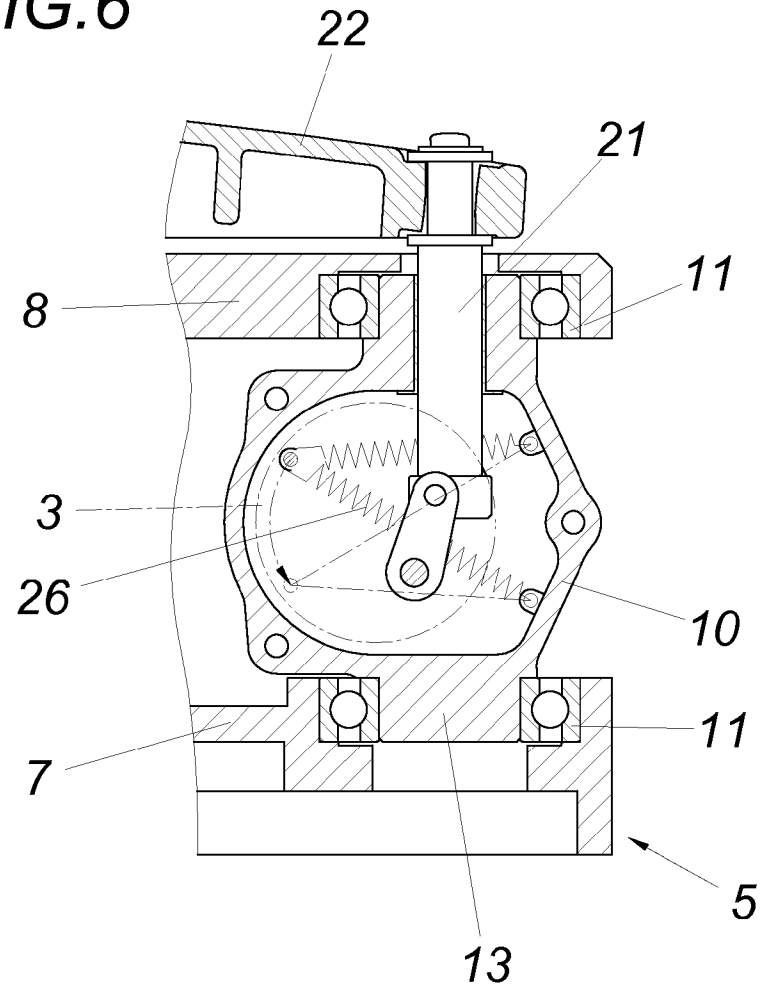
Figure 5:
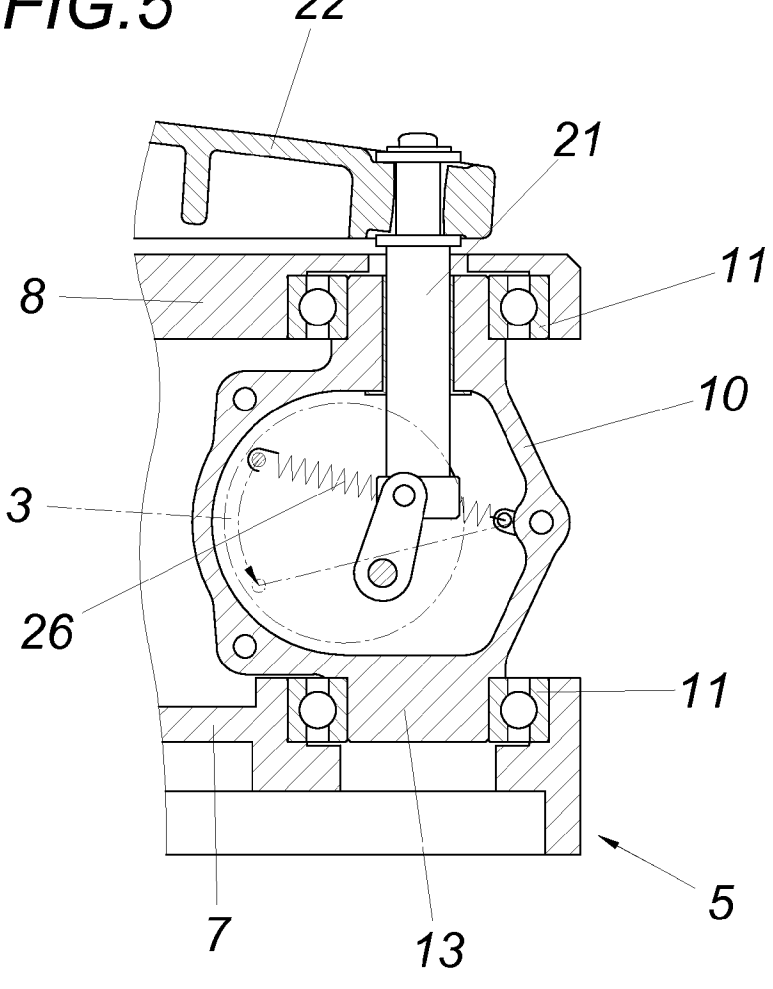

To support the rotational movement needed to feather and square the oar blades (1), the grip lever (3) can be fitted with a spring configuration (26) as shown in FIGS. 5 and 6. This spring configuration (26) causes torque to be applied to the grip lever (3) in both the limit positions, when the line of action of the spring configuration (26) is shifted from one side of the geometric axis of rotation of the grip lever (3) to the other side. In the example shown in FIG. 5, the spring configuration (26) consists of a tension spring acting between the grip lever (3) and the relevant bearing body (10). In the limit position shown in FIG. 5, the second actuator rod (21) is held at its limit of travel by the spring configuration (26). To rotate the grip lever (3) away from this limit position, the grip lever (3) first has to be rotated against the force of the spring configuration (26) until the line of action of the spring configuration (26) intersects the axis of rotation of the grip lever (3). The spring configuration (26) then applies force to the grip lever (3) in the direction of rotation to support the rotation of oar blade (1) into the feathered position. The limit position of the grip lever (3) is shown by the broken line that indicates the relevant position of the tension spring. To rotate the oar blade (1) into the squared position, the sequence is in the reverse order.

In FIG. 6 the spring configuration (26) is implemented as two tension springs that are articulated between the grip lever (3) and the second bearing body (10). Because these two tension springs form a shared line of action, the force of the spring applied to the grip lever (3) is similar to the spring configuration (26) shown in FIG. 5. The position of spring configuration (26) for the opposite limit of rotation of the grip lever (3) is also indicated by a broken line.

What is claimed is:

1. An apparatus for rowing in the direction the rower is facing, the apparatus comprising:

a counteracting four-bar linkage system comprising:

a base frame, the base frame comprising first bearings and second bearings, a grip lever, the grip lever having a grip lever axis and being a crank of the counteracting four-bar linkage system, an oar lever, the oar lever having an oar lever axis and being a driven arm of the counteracting four-bar linkage system, and a linkage, a first bearing body mounted in the base frame via the first bearings and comprising a first main axle, the linkage being connected to the first bearing body, the oar lever being mounted in the first bearing body so as to be rotatable about the oar lever axis, a second bearing body mounted in the base frame via the second bearings and comprising a second main axle, the grip lever being mounted in the second bearing body so as to be rotatable about the grip lever axis, the linkage being connected to the second bearing body, a rotary drive at the first bearing body, the rotary drive comprising a first actuator rod, the first actuator rod being coaxial with the first main axle of the first bearing body, the oar lever being connected to the rotary drive, a second actuator rod, the second actuator rod being actuated by the grip lever and being coaxial with the second main axle, and a seesaw mounted on the base frame and having a first side and a second side, the second actuator rod engaging with the first side of the seesaw, the first actuator rod engaging with the second side of the seesaw, wherein an actuation of the second actuator rod causes the seesaw to shift the first actuator rod.

2. The apparatus according to claim 1, wherein the rotary drive further comprises:

a toggle lever between the first bearing body and the oar lever, and a toggle joint connected to the toggle lever.

3. The apparatus according to claim 2, wherein the first actuator rod has a first actuator end and a second actuator end, and wherein the first actuator rod is connected to the seesaw at the first actuator end and, via the toggle joint, to the toggle lever of the rotary drive at the second actuator end.

4. The apparatus according to claim 2, further comprising a lug connected to the toggle joint, wherein the first actuator rod is implemented such that the shifting occurs coaxially to the first main axle of the first bearing body, and wherein the first actuator rod is connected to the lug.

5. The apparatus according to claim 1, wherein the grip lever forms a crank to drive the second actuator rod.

6. The apparatus according to claim 1, further comprising a spring configuration between the grip lever and the second bearing body, the spring configuration being configured to apply torque to the grip lever.

7. The apparatus according to claim 1, further comprising a connecting link connected to the grip lever, wherein the second actuator rod has a first end and a second end, wherein the first end of the second actuator rod is connected to the seesaw and the second end of the second actuator rod is connected to the connecting link.

8. The apparatus according to claim 1, further comprising a connecting link connected to the grip lever, wherein the second actuator rod is implemented such that the actuation occurs coaxially to the second main axle of the second bearing body, and wherein the second actuator rod is connected to the connecting link.

* * * * *